US011555607B1

(12) United States Patent
Wei

(10) Patent No.: US 11,555,607 B1
(45) Date of Patent: Jan. 17, 2023

(54) DIVING LAMP WITH EFFICIENT WATERPROOF PERFORMANCE

(71) Applicant: SHENZHEN XIANGYU OPTOELECTRONICS TECHNOLOGY CO., LTD, Shenzhen (CN)

(72) Inventor: Min Wei, Shenzhen (CN)

(73) Assignee: SHENZHEN XIANGYU OPTOELECTRONICS TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 17/712,086

(22) Filed: Apr. 2, 2022

(30) Foreign Application Priority Data

Feb. 7, 2021 (CN) ..... 202110169242.3

(51) Int. Cl.

| | |
|---|---|
| ***F21V 31/00*** | (2006.01) |
| ***F21L 4/02*** | (2006.01) |
| ***F21V 13/04*** | (2006.01) |
| ***F21V 15/01*** | (2006.01) |
| *B63C 11/02* | (2006.01) |
| *F21Y 115/10* | (2016.01) |

(52) U.S. Cl.
CPC ..... *F21V 31/005* (2013.01); *F21L 4/027* (2013.01); *F21V 13/045* (2013.01); *F21V 15/01* (2013.01); *B63C 11/02* (2013.01); *F21Y 2115/10* (2016.08)

(58) Field of Classification Search
CPC ..... F21V 31/005; F21V 13/045; F21V 15/01; F21L 4/027; F21Y 2115/10; B63C 11/02
See application file for complete search history.

(56) References Cited

U.S. PATENT DOCUMENTS

2013/0148351 A1* 6/2013 Georgitsis ..... F21V 17/12 362/249.02
2018/0009513 A1* 1/2018 Christensen ..... F21V 31/005

FOREIGN PATENT DOCUMENTS

| | | | |
|---|---|---|---|
| CN | 101206012 | A | 6/2008 |
| CN | 101761782 | A | 6/2010 |
| CN | 102052657 | A | 5/2011 |
| CN | 103453503 | A | 12/2013 |
| CN | 205278357 | U | 6/2016 |
| CN | 206112072 | U | 4/2017 |
| CN | 107120627 | A | 9/2017 |

(Continued)

*Primary Examiner* — Anabel Ton
(74) *Attorney, Agent, or Firm* — Bayramoglu Law Offices LLC

(57) ABSTRACT

An underwater diving light with efficient waterproof performance includes a top cover, a bottom cover, a light-emitting assembly and a special-shaped light-transmitting seal. A first installation groove is formed in the top cover. A second installation groove is formed in the bottom cover. The special-shaped light-transmitting seal includes a light-transmitting waterproof part, a first installation part and a second installation part. The first installation part, the light-transmitting waterproof part and the second installation part are all annular and connected in sequence. The top cover and the bottom cover are movably connected to form a light housing. The light-emitting assembly is arranged in the light housing. The underwater diving light has the advantages of strong waterproof and moisture-proof performance, diversified luminous forms and a dazzling effect.

10 Claims, 12 Drawing Sheets

(56) References Cited

FOREIGN PATENT DOCUMENTS

| | | | |
|---|---|---|---|
| CN | 206513823 | U | 9/2017 |
| CN | 103453503 | B | 7/2018 |
| CN | 207893695 | U | 9/2018 |
| CN | 208709493 | U | 4/2019 |
| CN | 209909745 | U | 1/2020 |
| CN | 209942607 | U | 1/2020 |
| CN | 210035290 | U | 2/2020 |
| CN | 211040908 | U | 7/2020 |
| CN | 214249393 | U | 9/2021 |

* cited by examiner

D

DIVING LAMP WITH EFFICIENT WATERPROOF PERFORMANCE

CROSS REFERENCE TO THE RELATED APPLICATIONS

This application is based upon and claims priority to Chinese Patent Application No. 202110169242.3, filed on Feb. 7, 2021, the entire contents of which are incorporated herein by reference.

TECHNICAL FIELD

The present disclosure relates to the technical field of lamps, in particular, to an underwater diving light with efficient waterproof performance.

BACKGROUND

Underwater lamps, which refer to lights installed under the water, are small, delicate and elegant in appearance, and may emit light under the water to enhance an ambient atmosphere and improve people's sense of pleasure.

Commonly used underwater lights need to work underwater, so they have certain requirements for waterproof performance. Generally, the water is prevented from entering the lights through housings of the underwater lights, so as to avoid damage to parts inside the underwater lights. After long-term use, the water still leaks into the underwater lights. Usually, waterproof rings are arranged at the joints of the housings to prevent the water from leaking into the underwater lights from the joints.

However, the underwater lights installed with the waterproof rings currently have the following problems: when the housings of the underwater lights are tightened, the waterproof rings will be driven and then extruded and deformed, and the water will seep into wrinkled positions of the waterproof rings to cause water leakage. In addition, the existing underwater lights have a single luminous form and may not achieve a dazzling effect.

In view of the above-mentioned related technologies, the inventors of the present disclosure provide modifications and improvements to the existing underwater lamps.

SUMMARY

In view of the deficiencies of the prior art, the present disclosure provides an underwater diving light with efficient waterproof performance, which has the advantages of strong waterproof and moisture-proof performance, diversified luminous forms and a dazzling effect.

The present disclosure is implemented through the following technical solution: an underwater diving light with efficient waterproof performance includes a top cover, a bottom cover, a light-emitting assembly and a special-shaped light-transmitting seal, where the top cover is provided with a first installation groove; the first installation groove is arranged outside an opening of the top cover; the bottom cover is provided with a second installation groove; the second installation groove is arranged outside an opening of the bottom cover; the special-shaped light-transmitting seal includes a light-transmitting waterproof part, a first installation part accommodated in the first installation groove and a second installation part accommodated in the second installation groove; the first installation part, the light-transmitting waterproof part and the second installation part are connected in sequence; the light-transmitting waterproof part is arranged outside the first installation groove; the light-transmitting waterproof part abuts on an outer edge of the first installation groove; the outer edge of the first installation groove is provided with a refraction part configured to allow light emitted by the light-emitting assembly to penetrate the top cover; the light-transmitting waterproof part and the refraction part correspond to each other in position; the top cover and the bottom cover are movably connected to form a light housing with an accommodating space; and the light-emitting assembly is arranged in the light housing.

Optionally, the first installation part includes a first sub-part and a second sub-part arranged from bottom up; the widths of the longitudinal sections of the first sub-part are all the same from bottom up; the widths of the longitudinal sections of the second sub-part are gradually reduced from bottom up; and an inner space of the first installation groove matches with the first installation part in shape.

Optionally, the widths of the longitudinal sections of the second installation part are gradually reduced from top down; and an inner space of the second installation groove matches with the second installation part in shape.

Optionally, the top cover includes a connecting piece and a cover body; an opening of the cover body is arranged downwards; the connecting piece is fixedly connected to an edge of an inner side wall of the cover body; the connecting piece is made of a non-light-transmitting material; and the cover body is made of a light-transmitting material.

Optionally, the special-shaped light-transmitting seal is made of an elastic transparent material.

Optionally, the bottom of an outer wall of the bottom cover is fixedly provided with suction cup buckles.

Optionally, the underwater diving light further includes a moisture-proof cover in which desiccants are stored.

Optionally, the refraction part is a plurality of light-transmitting mirrors arranged at intervals on the outer edge of the first installation groove.

Optionally, the special-shaped light-transmitting seal further includes a vacuum suction part; the vacuum suction part is connected with the first installation part; the vacuum suction part is provided with clamping strips and an elastic suction cup configured to cooperatively suck the bottom of the first installation groove; the clamping strips are arranged on an outer edge of the elastic suction cup; and a clamping groove configured to accommodate the clamping strips are formed in a joint between an inner groove wall of the first installation groove and the bottom of the first installation groove in a sunken manner.

Optionally, the top cover is further provided with a locking groove; a longitudinal section of the locking groove is triangular, circular, oval or trapezoidal; the locking groove communicates with the first installation groove; the width of the longitudinal section of the locking groove is greater than that of a longitudinal section of the first installation groove at a joint between the locking groove and the first installation groove; the special-shaped light-transmitting seal further comprises a locking part; the locking part is connected with the first installation part; and the width of a longitudinal section of the locking part is greater than that of a longitudinal section of the first installation part at a joint between the locking part and the first installation part.

Compared with the prior art, the present disclosure has the following beneficial effects:

1. The present disclosure is simple in structure and low in production cost; the special-shaped light-transmitting seal is arranged; the first installation part is used to be installed in cooperation with the first installation groove, and the second installation part is used to be installed in cooperation with the second installation groove; and the water is isolated in cooperation with the light-transmitting waterproof part, which is beneficial to prevent water droplets in an external environment from entering a light cover when the light cover is opened.

2. The first installation part and the second installation part are arranged and combined with the light-transmitting waterproof part to form a similar inverted T shape "I", so that a contact area between the special-shaped light-transmitting seal and the light housing is enlarged, frictional force is increased, and multi-directional contact is achieved. Accordingly, the light-transmitting waterproof part is less likely to move and produce wrinkles, and has better stability, thereby effectively reducing the water leakage and damage of the light due to wrinkling of the seal.

3. The depth of the first installation part extending into the first installation groove is increased through the first sub-part, thereby extending a flow path of the water, reducing the possibility of the water flowing into the light along the first installation groove, and improving a water isolation effect.

4. The widths of the longitudinal sections of the second sub-part are gradually reduced from bottom up, the longitudinal sections refers to the section plane obtained by cutting the second sub-part parallel to the longitudinal axis of the top cover, thereby making it more convenient for the first installation part to be installed in the first installation groove; and the widths of the longitudinal sections of the second installation part are gradually reduced from top down, thereby making it more convenient for the second installation part to be installed in the second installation groove.

5. Through the refraction part, the light emitted by the light-emitting assembly penetrates the refraction part and is refracted to the light-transmitting waterproof part, the light-transmitting waterproof part refracts the light correspondingly, and the special-shaped light-transmitting seal emits the corresponding light, thereby achieving the diversified luminous forms and the more dazzling effect.

BRIEF DESCRIPTION OF THE DRAWINGS

The accompanying drawings described herein are used to provide a further understanding of the present application, and constitute a part of the present application. The schematic embodiments and descriptions of the present application are used to explain the present application, and do not constitute an improper limitation of the present application. In the accompanying drawings.

DESCRIPTION OF DRAWING SYMBOLS

Figure 1:
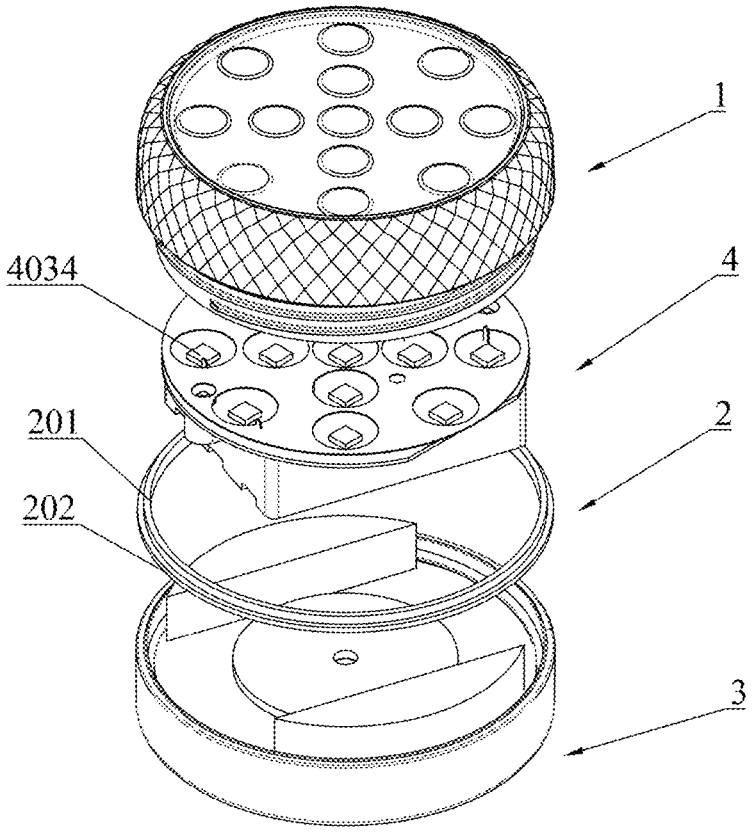
FIG. 1 shows a schematic diagram of a disassembled overall structure 1 of an light emitting diode (LED) light in an embodiment 1.
Figure 2:
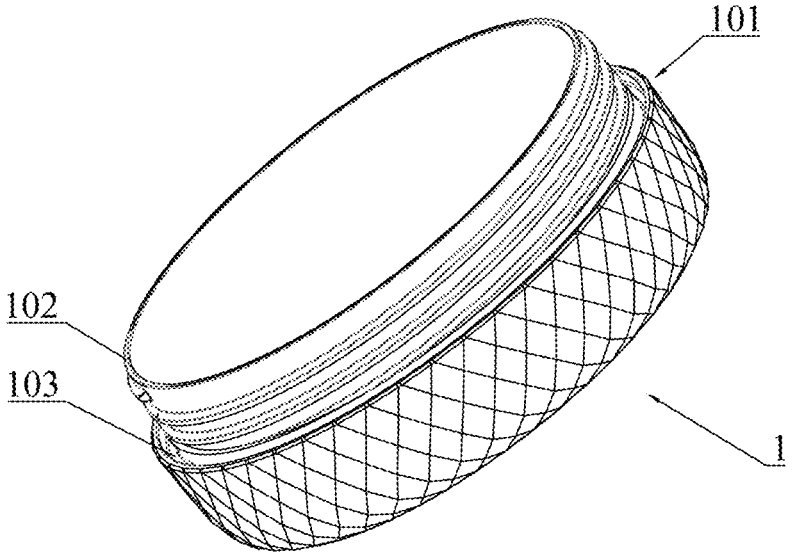
FIG. 2 shows a schematic diagram of an external structure of a first type of top cover in the embodiment 1.

1, top cover; 2, special-shaped light-transmitting seal; 3, bottom cover; 4, lighting-emitting assembly; 5, moisture-proof cover; 6, desiccant; 7, iron counterweight; 8, moisture-proof sticker; 9, magnet; 10, suction cup buckle; 101, cover body; 102, connecting piece; 103, first installation groove; 104, first installation column; 105, positioning column; 106, scattered light hole; 107, clamping strip; 108, locking groove; 109, welding groove; 110, positioning hole; 1012, second installation groove; 1013, refraction part; 201, first installation part; 202, light-transmitting waterproof part; 203, second installation part; 204, locking part; 205, vacuum suction part; 206, elastic suction cup; 207, clamping strip; 208, clamping groove; 209, reflector; 2011, first sub-part; 2012, second sub-part; 302, fixing column; 303, first installation groove of suction cup; 401, reflective sheet; 402, EVA pad; 403, circuit board; 404, battery box; 405, battery piece; 4011, first bayonet; 4012, first positioning hole; 4013, first installation hole; 4014, light-transmitting hole; 4031, second bayonet; 4032, second positioning hole; 4033, second installation hole; 4034, LED light; 4041, second installation column; 501, square part; 502, arc-shaped part; 701, first fixing hole; and 801, second fixing hole.

DETAILED DESCRIPTION OF THE EMBODIMENTS

Various embodiments of the present disclosure will be disclosed in the drawings below. For the sake of clarity, many practical details will be described in the following description. However, it should be understood that these practical details should not be used to limit the present disclosure. That is, in some embodiments of the present disclosure, these practical details are not necessary. In addition, to simplify the drawings, some conventional structures and assemblies will be shown in the drawings in a simple schematic way. Longitudinal refers to the direction parallel to the longitudinal axis of the top cover. It should be noted that all directional indicators (such as up, down, left, right, front, back . . . ) in the embodiments of the present disclosure are merely used to explain relative position relationships, movement and etc. among various components under a specific attitude (as shown in the accompanying drawings). If the specific attitude changes, the directional indicators change accordingly.

In the present disclosure, unless otherwise expressly specified and limited, the terms such as "connected" and "fixed" should be understood in a broad sense. For example, the "fixed" may be a fixed connection, an indirect connection through intermediate media, an internal communication between two elements or an interaction between two elements, unless otherwise expressly limited. Those of ordinary skill in the art may understand specific meanings of the above terms in the present disclosure according to specific circumstances.

In addition, the descriptions such as "first" and "second" in the present disclosure are merely used to describe an objective, and neither particularly refer to the meaning of order or sequence, nor are used to limit the present disclosure. The descriptions are merely intended to distinguish assemblies or operations described in the same technical terms, and should not be understood as indicating or implying their relative importance or implying the number of indicated technical features. Therefore, features defined by "first" and "second" may explicitly or implicitly include at least one of the features. Furthermore, the technical solutions among the various embodiments may be combined with one another, but must be based on the realization by those of ordinary skill in the art. When the combination of the technical solutions is contradictory or may not be realized, it should be considered that the combination of the technical solutions does not exist and is not within the scope of protection required by the present disclosure.

The present disclosure provides an underwater diving light with efficient waterproof performance.

Embodiment 1

Figure 3:
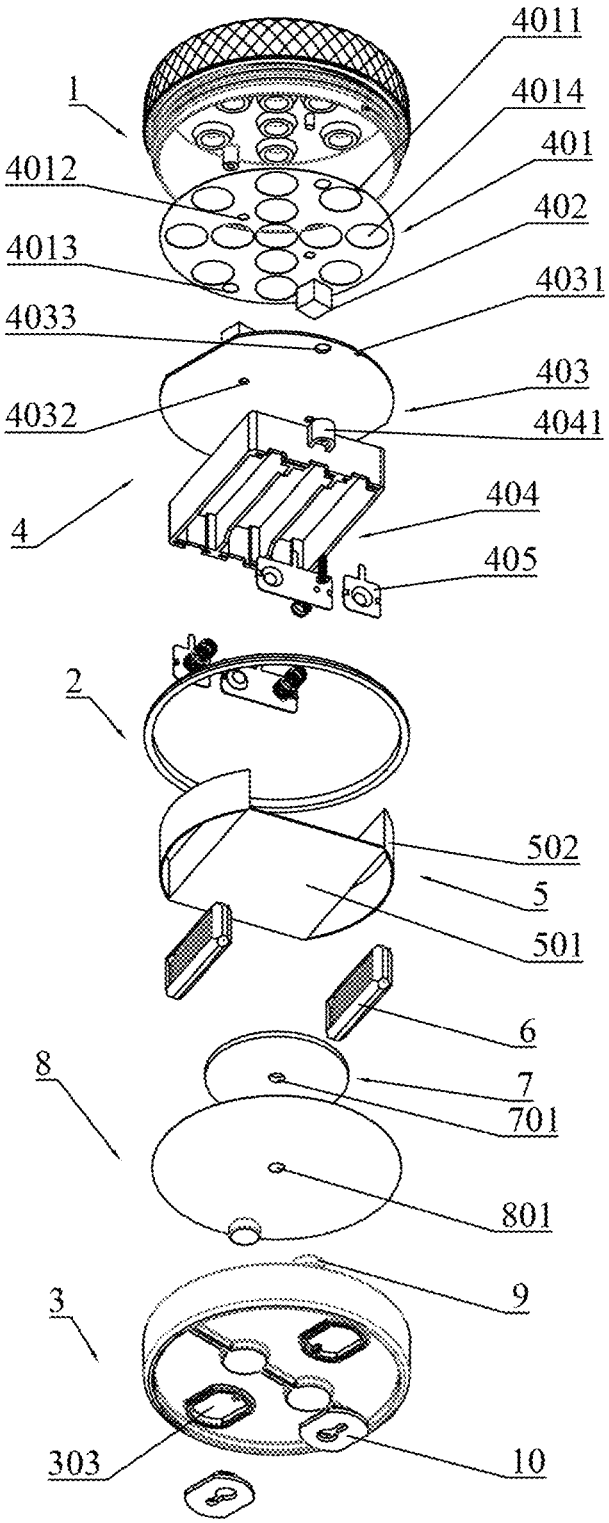
FIG. 3 shows a schematic diagram of a disassembled overall structure 2 of the LED light in the embodiment 1.

Referring to FIG. 1 and FIG. 3, in this embodiment, an underwater diving light with efficient waterproof performance includes a top cover 1, a bottom cover 3, a light-emitting assembly 4 and a special-shaped light-transmitting seal 2, where the top cover 1 is provided with a first installation groove 103; the first installation groove 103 is annular; the first installation groove 103 is arranged outside an opening of the top cover 1; the bottom cover 3 is provided with a second installation groove 1012; the second installation groove 1012 is annular; the second installation groove 1012 is arranged outside an opening of the bottom cover 3; the special-shaped light-transmitting seal 2 includes a light-transmitting waterproof part 202, a first installation part 201 accommodated in the first installation groove 103 and a second installation part 203 accommodated in the second installation groove 1012; the first installation part 201, the light-transmitting waterproof part 202 and the second installation part 203 are all annular and connected in sequence; the light-transmitting waterproof part 202 is arranged outside the first installation groove 103; the light-transmitting waterproof part 202 abuts on an outer edge of the first installation groove 103; the outer edge of the first installation groove 103 is provided with a refraction part 1013 configured to allow light emitted by the light-emitting assembly 4 to penetrate the top cover 1; the light-transmitting waterproof part 202 and the refraction part 1013 correspond to each other in position; the top cover 1 and the bottom cover 3 are movably connected to form a light housing with an accommodating space; and the light-emitting assembly 4 is arranged in the light housing.

Where, the top cover 1 includes a connecting piece 102 and a cover body 101; the connecting piece 102 and the cover body 101 are integrally formed; the top cover 1 is circular and has an opening that is arranged downwards; an opening of the cover body 101 is arranged downwards; the connecting piece 102 is fixedly connected to an edge of an inner side wall of the cover body 101; the connecting piece 102 is made of a non-light-transmitting material; and the cover body 101 is made of a light-transmitting material. A part, beyond the opening of the cover body 101, of the connecting piece 102 is provided with an external thread, and the external thread is formed in an outer side of the connecting piece 102; and the first installation groove 103 is arranged outside the opening of the top cover 1, and the first installation groove 103 is the annular groove with a downward opening and is located between the cover body 101 and the connecting piece 102. The second installation groove 1012 is arranged outside the opening of the bottom cover 3, and the second installation groove 1012 is the annular groove with an upward opening. The connecting piece 102 is made of a non-light-transmitting material, so that no scattered light is scattered through the connecting piece 102 when the light emits light, and the light is more attractive in use.

In further embodiments, the connecting piece 102 is specifically a connecting ring 102, the first installation groove 103 and the second installation groove 1012 are both annular, and the corresponding first installation part 201 and second installation part 203 are also both annular.

Figure 6:
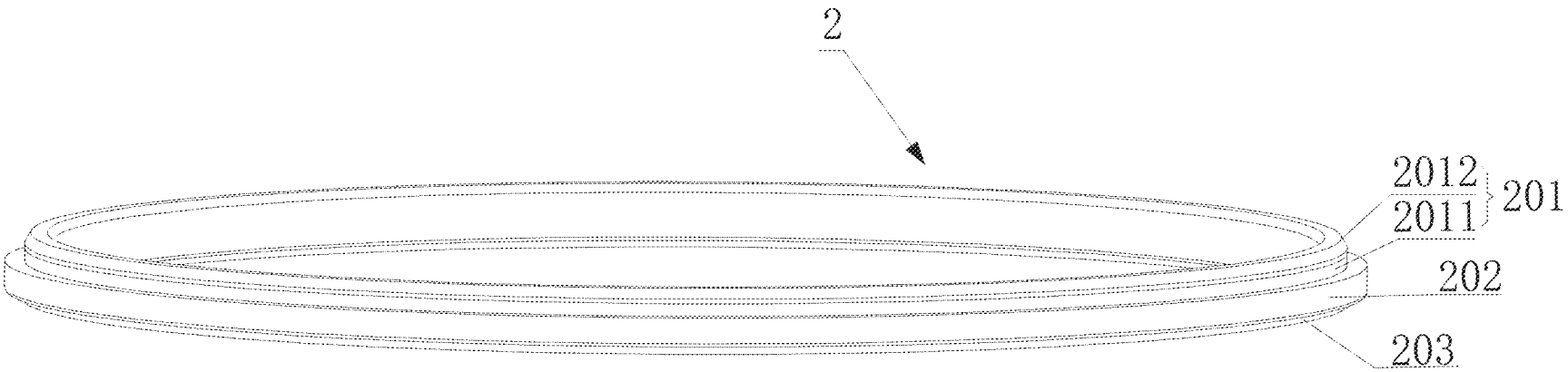
FIG. 6 shows an overall schematic diagram of a special-shaped light-transmitting seal in the embodiment 1.

Referring to FIG. 6, the special-shaped light-transmitting seal 2 includes the first installation part 201, the second installation part 203 and the light-transmitting waterproof part 202; the first installation part 201, the second installation part 203 and the light-transmitting waterproof part 202 are all integrally formed; the first installation part 201 matches with an inner space of the first installation groove 103 in shape; and the first installation part 201 may be installed in the first installation groove 103 and is in interference fit therewith; the second installation part 203 matches with an inner space of the second installation groove 1012 in shape; and the second installation part 203 may be installed in the second installation groove 1012 and is in interference fit therewith.

In further embodiments, the special-shaped light-transmitting seal 2 is made of an elastic transparent material. The specific elastic transparent material may be a silica gel material, etc. Therefore, the closeness of the light-transmitting seal and the light housing is improved, the waterproofness is enhanced, and the possibility of water seepage is reduced. An internal thread is formed in an inner side wall of the bottom cover 3; and during installation, the light-emitting assembly 4 is fixed in the top cover 1 by screws to provide a light source for the light, then the top cover 1 or the bottom cover 3 is twisted to connect the top cover 1 and the bottom cover 3 to form the complete light housing by cooperation of the external thread and the internal thread, a lower side surface of the light-transmitting waterproof part 202 clings to an edge of an upper end surface of the bottom cover 3, and an upper side surface of the light-transmitting waterproof part 202 clings to an edge of an upper end surface of the top cover 1. The first installation groove 103 is arranged to fix and clamp the first installation part 201, and the second installation groove 1012 is arranged to fix and clamp the second installation part 203, so that the light-transmitting waterproof part 202 is more stable; and when the top cover 1 and the bottom cover 3 are connected and fixed by twisting, the light-transmitting waterproof part 202 is cooperatively used for water isolation, which is beneficial to prevent water droplets in an external environment from entering a light cover when the light cover is opened. The first installation part 201 and the second installation part 203 are arranged and combined with the light-transmitting waterproof part 202 to form a similar inverted T shape, so that a contact area between the special-shaped light-transmitting seal 2 and the light housing is enlarged, frictional force is increased, and multi-directional contact is achieved. Accordingly, the light-transmitting waterproof part 202 is less likely to move to produce wrinkles, thereby effectively reducing the water leakage and damage of the light due to wrinkling of the seal. Meanwhile, since the special-shaped seal is arranged outside the opening of the top cover 1, that is, the special-shaped seal is arranged on the outer side of the connecting piece 102, that forms the opening of the top cover, on the top cover 1, the external water may be effectively prevented from directly entering the top cover 1, and the high waterproof and moisture-proof performance is achieved. Specifically, the connecting piece 102 is preferably the connecting ring 102.

In further embodiments, the first installation part 201 includes a first sub-part 2011 and a second sub-part 2012 arranged from bottom up, i.e. the direction from the top cover to the bottom cover; the widths of the longitudinal sections of the first sub-part 2011 are all the same from bottom up; the widths W of the longitudinal sections of the second sub-part 2012 are gradually reduced from bottom up; and an inner space of the first installation groove 103 matches with the first installation part 201 in shape. The depth of the first installation part 201 extending into the first installation groove 103 is increased through the first sub-part 2011, thereby extending a flow path of the water, reducing the possibility of the water flowing into the light along the first installation groove 103, and improving a water isolation effect. The longitudinal sections in the present disclosure refers to the section planes obtained by cutting the object parallel to the longitudinal axis of the top cover. The widths of the longitudinal sections of the second sub-part 2012 are gradually reduced from bottom up, thereby making it more convenient for the first installation part 201 to be installed in the first installation groove 103; and the widths of the longitudinal sections of the second installation part 203 are gradually reduced from top down, thereby making it more convenient for the second installation part 203 to be installed in the second installation groove 1012.

In further embodiments, the widths of the longitudinal sections of the second installation part 203 are gradually reduced from top down; and an inner space of the second installation groove 1012 matches with the second installation part 203 in shape. Thus, it is more convenient for the second installation part 203 to be installed in the second installation groove 1012.

Figure 4:
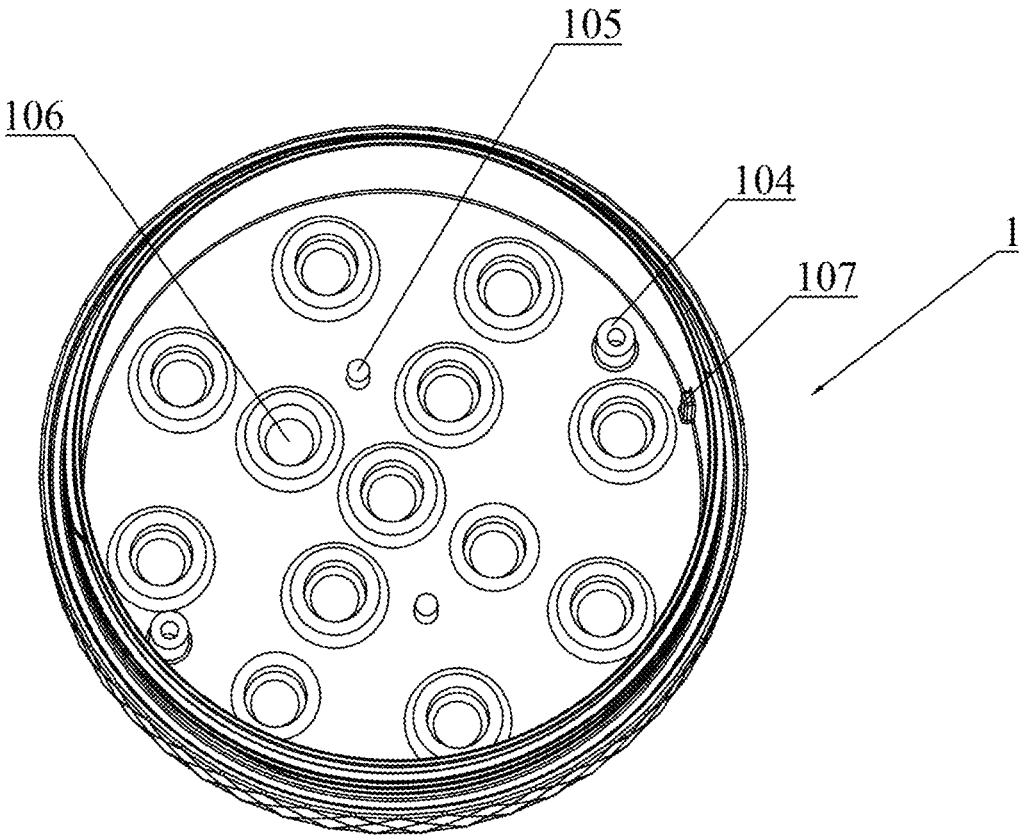
FIG. 4 shows a schematic diagram of an internal structure of the first type of top cover in the embodiment 1.

Referring to FIG. 1, FIG. 3 and FIG. 4, in this embodiment, an inner bottom of the top cover 1 is integrally formed with two first installation columns 104 and two positioning columns 105 that are vertical; the two first installation columns 104 are symmetrically arranged with respect to the center of the top cover 1; each of the first installation columns 104 is provided with a first screw hole that is vertical; the two positioning columns 105 are symmetrically arranged with respect to the center of the top cover 1; the positioning columns 105 are solid cylinders; the inner bottom of the top cover 1 is further provided with a plurality of scattered light holes 106; an inner side wall of the connecting piece 102 is vertically provided with clamping strips 107; the cover body 101 is provided with a positioning hole 110 configured to be in clamped connection with the clamping strips 107; the light-emitting assembly 4 includes a reflective sheet 401, an EVA pad 402, a circuit board 403, a battery box 404 and a battery piece 405; the reflective sheet 401 is circular and provided with a first bayonet 4011, two first positioning holes 4012, two first installation holes 4013 and a plurality of light-transmitting holes 4014; the first bayonet 4011 is arranged on an edge of the reflective sheet 401; the circuit board 403 is oval and provided with a second bayonet 4031, two second positioning holes 4032, two second installation holes 4033 and a plurality of LED lights 4034; the battery piece 405 is welded and fixed to the battery box 404; the battery box 404 is provided with two second installation columns 4041; the second installation columns 4041 are provided with second screw holes; the second screw holes vertically penetrate the second installation columns 4041; during installation, the reflective sheet 401, the EVA pad 402, the circuit board 403 and the battery box 404 are placed into the top cover 1 in sequence, at this time, the first bayonet 4011 and the second bayonet 4031 are clamped in the clamping strips 107 in sequence, the first positioning holes 4012 and the second positioning holes 4032 are sequentially sleeved on the positioning columns 105, and the screws pass through the second screw holes, the second installation holes 4033 and the first installation holes 4013 in sequence to be fixed in the first screw holes, thereby fixing the light-emitting assembly 4 and the top cover 1; and batteries may be installed in the battery box 404 to supply power to the LED lights 4034. An outer edge of the first installation groove 103 is provided with a refraction part 1013 configured to allow light emitted by the light-emitting assembly 4 to penetrate the top cover 1; and the light-transmitting waterproof part 202 and the refraction part 1013 correspond to each other in position. Through the arrangement, the light emitted by the light-emitting assembly 4 penetrates the refraction part 1013 and is refracted to the light-transmitting waterproof part 202, the light-transmitting waterproof part 202 refracts the light correspondingly, and the special-shaped light-transmitting seal 2 emits the corresponding light, thereby achieving diversified luminous forms and a more dazzling effect. Specifically, the refraction part 1013 is a plurality of light-transmitting mirrors arranged at intervals on the outer edge of the first installation groove 103. The light-transmitting mirrors adopt concave lenses; and when the light emitted by the light-emitting assembly 4 through the LED lights 4034 penetrates the concave lenses, the concave lenses scatter incident light beams to expand the coverage of the light, and the light is emitted through the light-transmitting waterproof part 202, so that the dazzling effect may be also achieved while the light-transmitting waterproof part 202 displays colors to outside.

The light-emitting assembly 4 further includes a wireless signal receiver, a wireless signal processor and a remote control; the wireless signal receiver is connected with the wireless signal processor; the wireless signal processor is connected with the circuit board 403; and the external remote control transmits a wireless signal of turn-on or turn-off, the wireless signal receiver receives the turn-on or turn-off signal, the wireless signal processor processes the signal, and the circuit board 403 outputs a processed signal, thereby controlling the LED lights 4034 on the circuit board 403 to be turned on or off.

Continuing to refer to FIG. 3, as shown in the figure, in this embodiment, the underwater diving light with efficient waterproof performance further includes a moisture-proof cover 5, where the moisture-proof cover 5 is configured to seal the batteries on the battery box 404, and desiccants 6 are stored on a side, facing the batteries, of the moisture-proof cover 5. Alternatively, the moisture-proof cover 5 includes a square part 501 configured to fasten the battery box 404; the square part 501 seal the batteries in the battery box 404; the moisture-proof cover 5 further includes two arc-shaped parts 502, namely storage devices; the two arc-shaped parts 502 are respectively located on a left side and a right side of the square part 501; the arc-shaped parts 502 have semi-circular cylinder accommodating spaces with downward openings; and the desiccants 6 may be placed in the semi-circular cylinder accommodating spaces to improve the moisture-proof performance of the light.

Figure 5:
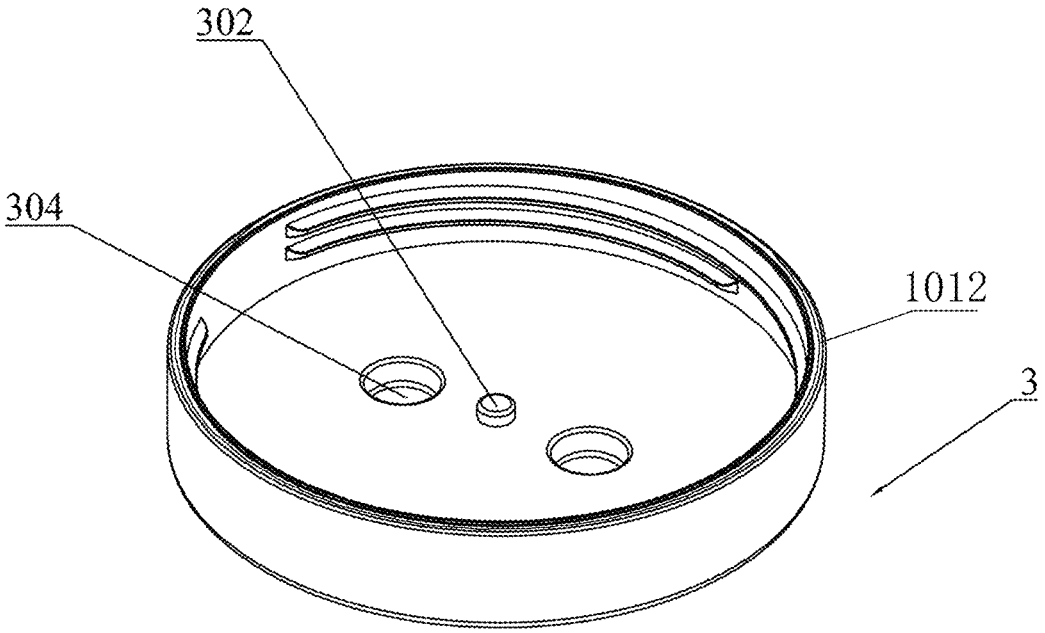
FIG. 5 shows a schematic diagram of an internal structure of a bottom cover in the embodiment 1.

Referring to FIG. 3 and FIG. 5, FIG. 5 is a schematic diagram of an internal structure of a bottom cover 3 in this embodiment. As shown in the figure, in this embodiment, In further embodiments, the bottom of an outer wall of the bottom cover 3 is fixedly provided with suction cup buckles 10, and the suction cup buckles 10 are configured to fix the light and an external structure. The underwater diving light with efficient waterproof performance further includes an iron counterweight 7, a moisture-proof sticker 8 and magnets 9; the iron counterweight 7 is circular and provided with a first fixing hole 701 in the center; the moisture-proof sticker 8 is circular and provided with a second fixing hole 801 in the center; the bottom of an inner side of the bottom cover 3 is provided with a fixing column 302 and two installation holes for the magnets 9; the two installation holes for the magnets 9 are symmetrically arranged with respect to the fixing column 302; the two magnets 9 are respectively installed in the installation holes for the magnets 9 and fixed by adhesives; the bottom of an outer side of the bottom cover 3 is provided with two first suction cup installation grooves 303; the moisture-proof sticker 8 and the iron counterweight 7 are respectively sleeved on the fixing column 302 through the second fixing hole 801 and the first fixing hole 701 in sequence and fixed by adhesives; the two suction cup buckles 10 are respectively installed in the first suction cup installation grooves 303; and the magnets 9 are fixed inside the light by the adhesives, and are sealed and protected by the moisture-proof sticker 8, thereby effectively preventing the magnets 9 from being in direct contact with water, and overcoming the defect that the magnets 9 are easily corroded by direct contact with the pool water.

A working principle of the present disclosure is as follows: first, the top cover 1 and the bottom cover 3, that are connected and fixed by the threads, are loosened, then the batteries are placed into the battery box 404, and the top cover 1 having the LED lights 4034 therein and the bottom cover 3 are connected and tightened by the threads. The LED lights 4034 are placed into a swimming pool, and the LED lights 4034 are fixed to an external installation frame on an edge of the swimming pool by the suction cup buckles 10, and are further fixed by magnetic force of the magnets 9; and the LED lights 4034 are controlled to be turned on or off by turning on or off the remote control.

Embodiment 2

Figure 7:
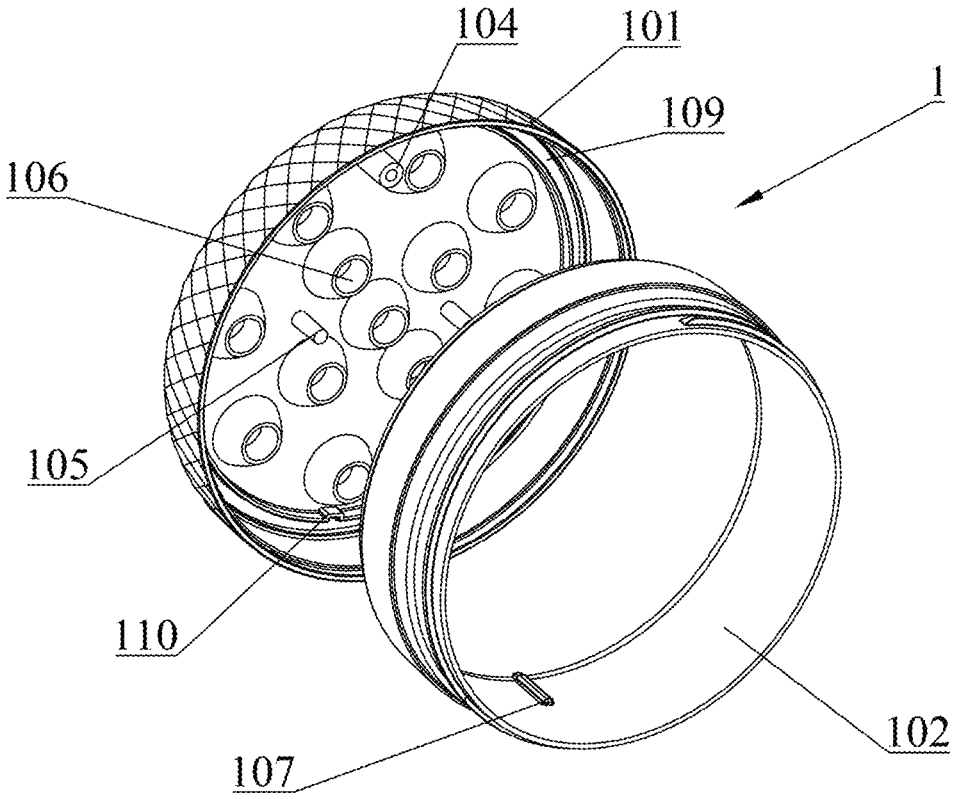
FIG. 7 shows an overall schematic diagram of a second type of top cover in an embodiment 2.
Figure 8:
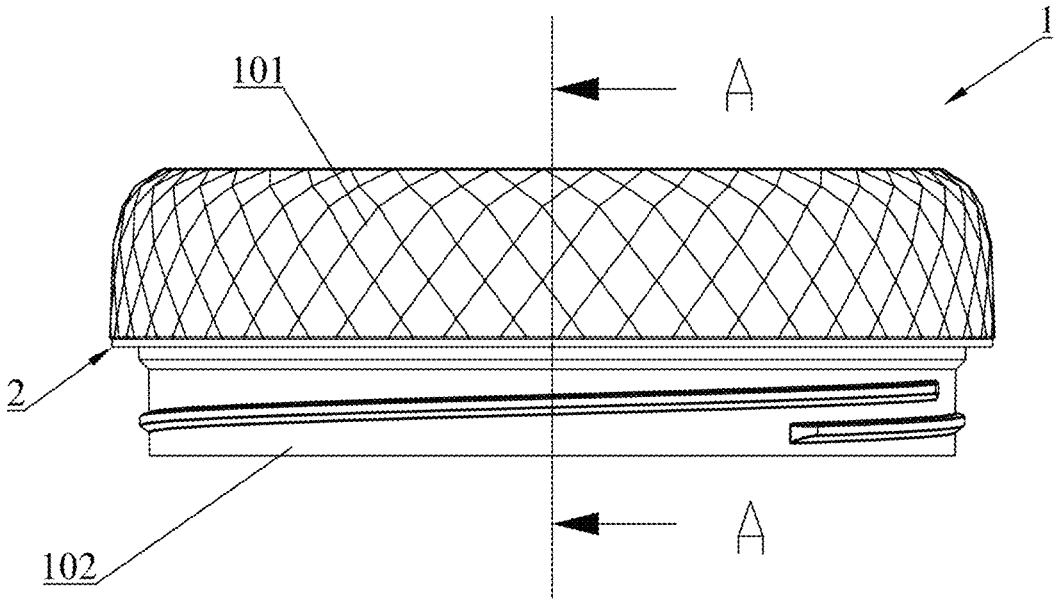
FIG. 8 shows a schematic front view of the second type of top cover in the embodiment 2.
Figure 9:
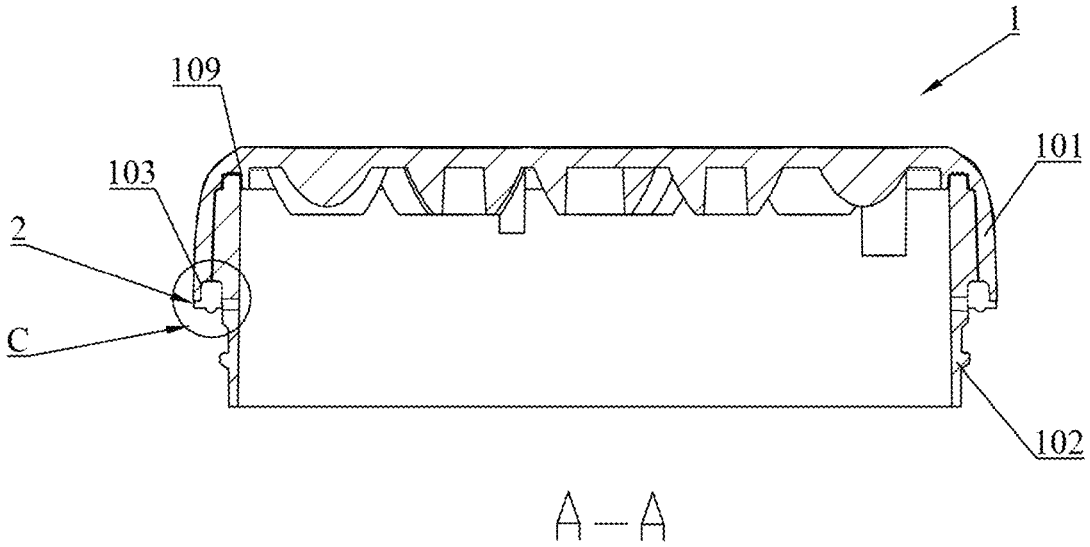
FIG. 9 shows a schematic cross-sectional view A-A of FIG. 8.
Figure 10:
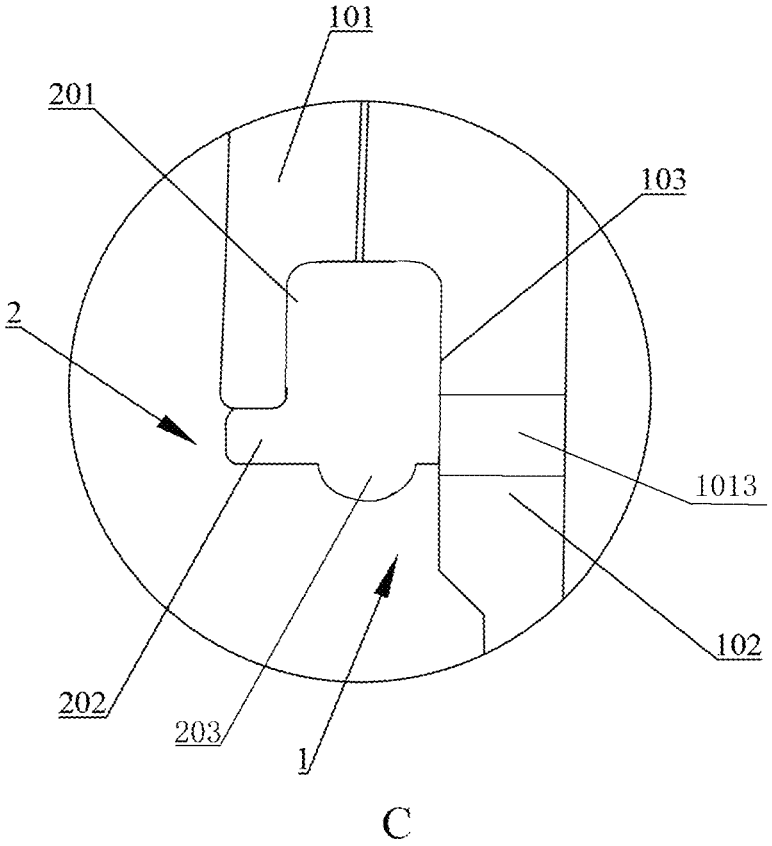
FIG. 10 shows a schematic enlarged view of a local part C of FIG. 7 in the embodiment 2.

A difference from the embodiment 1 is that, referring to FIGS. 7-10, FIG. 7 is an overall schematic diagram of a second type of top cover 1 in this embodiment, FIG. 8 is a schematic front view of the second type of top cover 1 in this embodiment, FIG. 9 is a schematic cross-sectional view A-A of FIG. 8 in this embodiment, and FIG. 10 is a schematic enlarged view of a local part C of FIG. 7 in this embodiment. In this embodiment, the top cover 1 is not made of a connecting piece 102 and a cover body 101 that are integrally formed, instead, the bottom of the connecting piece 102 is clamped in a welding groove 109 at the bottom of an inner side of the cover body 101, and then the connecting piece 102 and the cover body 101 are welded by ultrasonic waves to form the top cover 1. Thus, the production cost is reduced.

Embodiment 3

Figure 11:
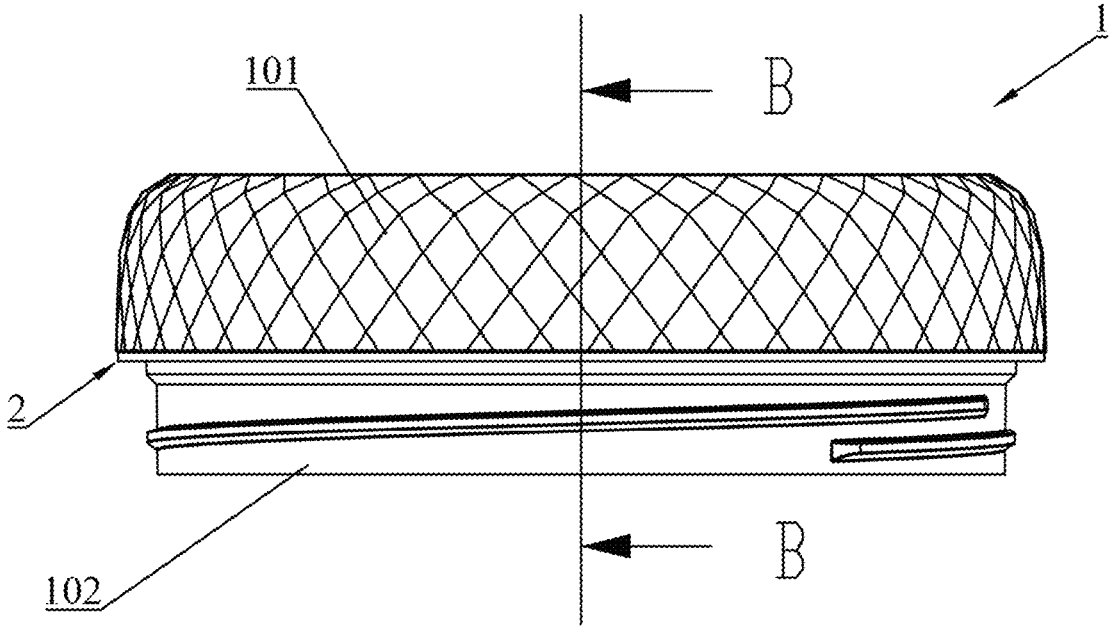
FIG. 11 shows a schematic front view of a second type of top cover when a locking groove structure is additionally arranged in an embodiment 3.
Figure 12:
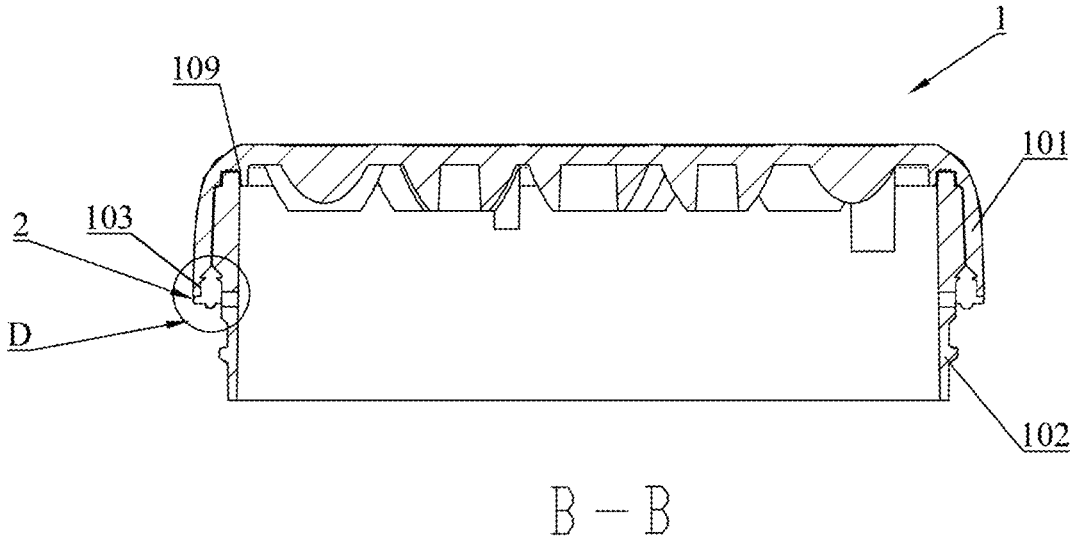
FIG. 12 shows a schematic cross-sectional view B-B of FIG. 11 in the embodiment 3.
Figure 13:
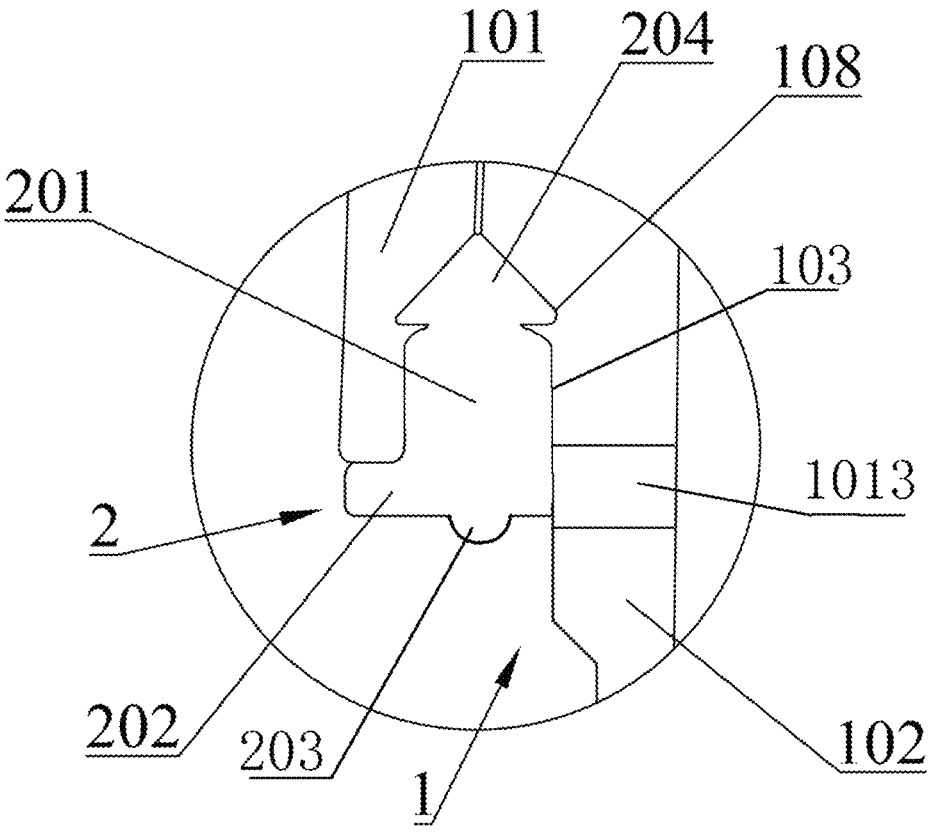
FIG. 13 shows a schematic enlarged view of a local part D of FIG. 12 in the embodiment 3.
Figure 14:
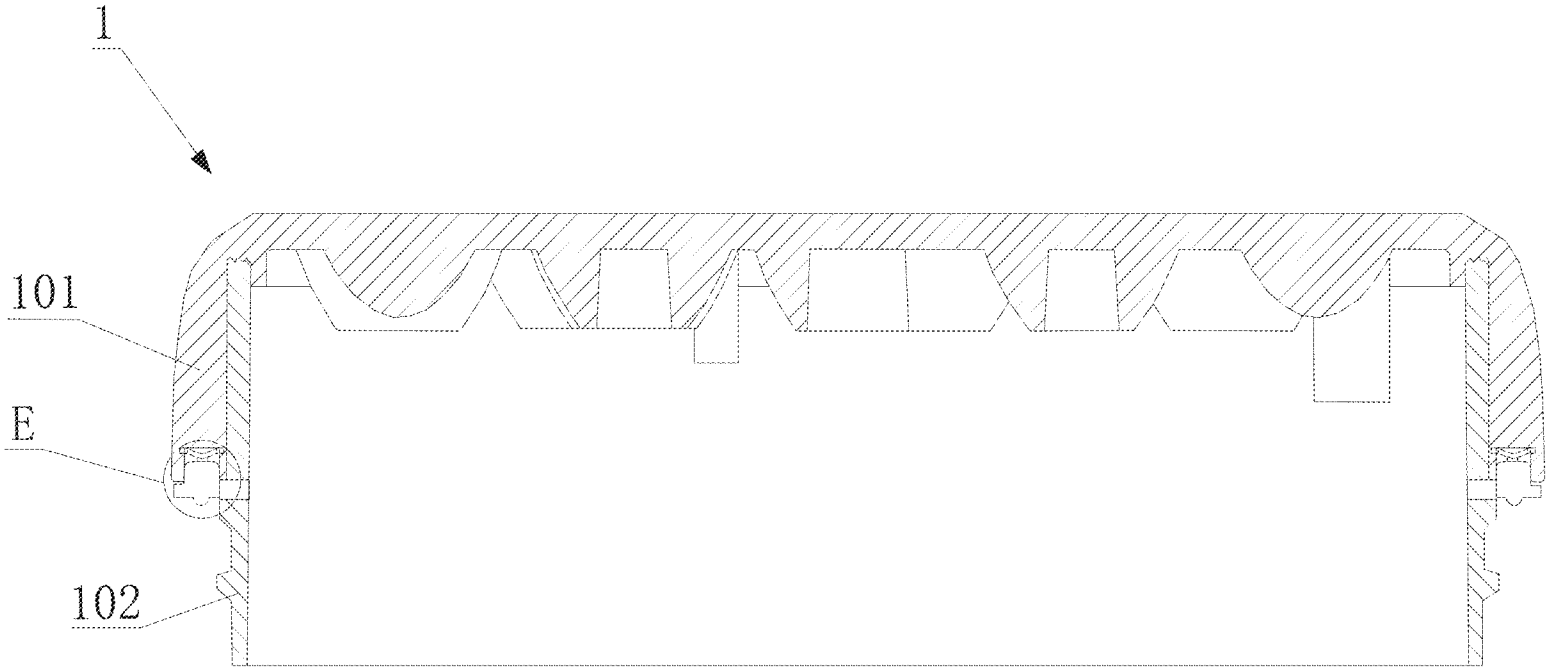
FIG. 14 shows a cross-sectional view of a first installation groove and an elastic suction cup of a third type of top cover when they are separated in an embodiment 4.
Figure 15:
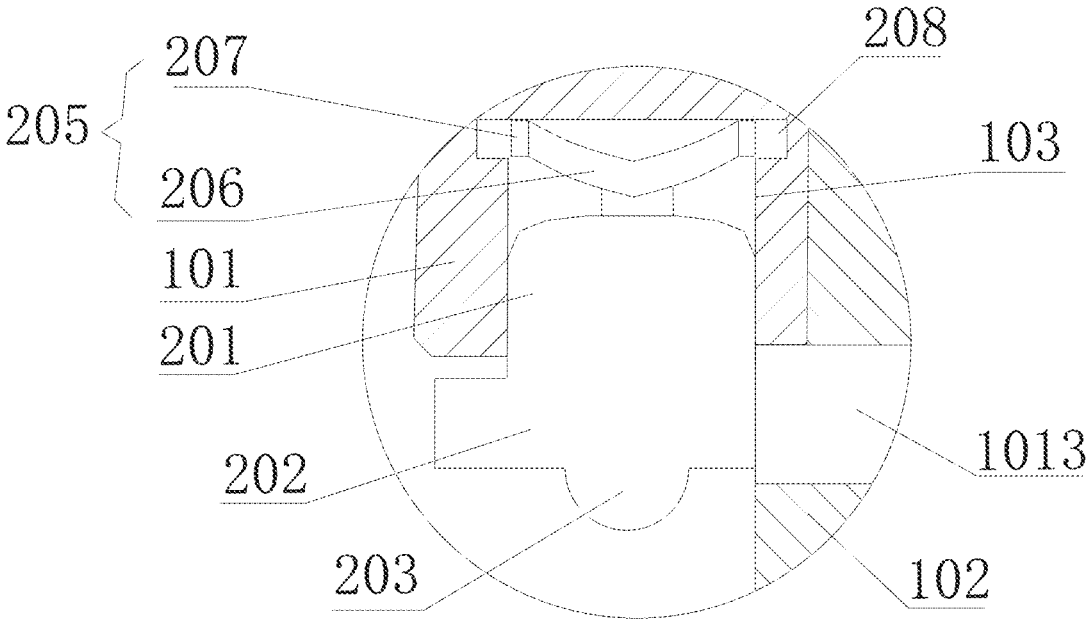
FIG. 15 shows a schematic enlarged view of a local part E of FIG. 14 in the embodiment 4.
Figure 16:
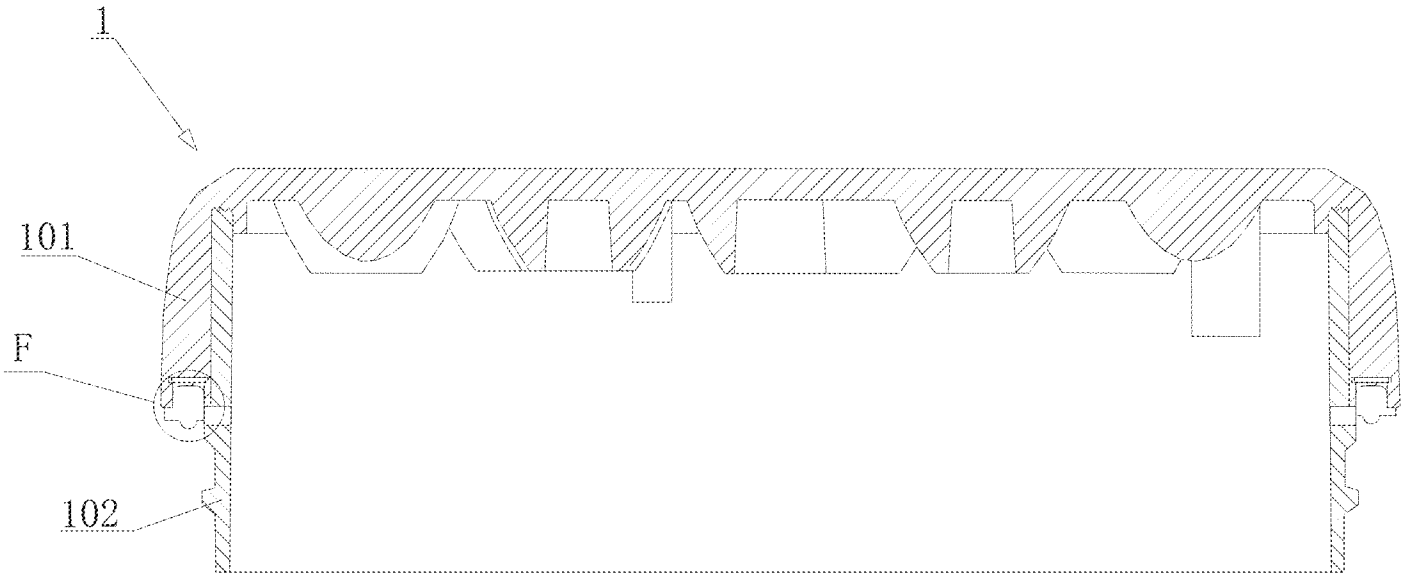
FIG. 16 shows a cross-sectional view of the first installation groove and the elastic suction cup of the third type of top cover when the first installation groove is sucked by the elastic suction cup in the embodiment 4.
Figure 17:
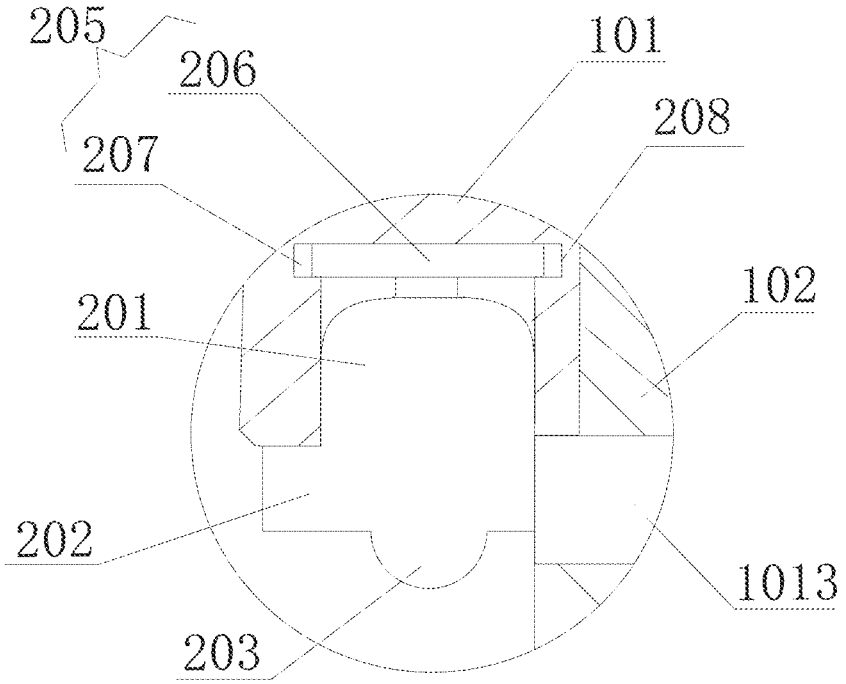
FIG. 17 shows a schematic enlarged view of a local part F of FIG. 16 in the embodiment 4.

A difference from the embodiment 1 and the embodiment 2 is that, referring to FIGS. 11-13, FIG. 11 is a schematic front view of a second type of top cover 1 when a locking groove 108 is additionally arranged in this embodiment, FIG. 12 is a schematic cross-sectional view B-B of FIG. 11 in this embodiment, and FIG. 13 is a schematic enlarged view of a local part D of FIG. 11 in this embodiment. In this embodiment, the top cover 1 is further provided with the locking groove 108; specifically, a longitudinal section of the locking groove 108 is triangular, circular, oval or trapezoidal, the locking groove 108 communicates with a first installation groove 103, and the width of a bottom edge of the longitudinal section of the locking groove 108 is greater than that of a longitudinal section of the first installation groove 103 at a joint therebetween; a special-shaped light-transmitting seal 2 further includes a locking part 204; the locking part 204 is connected with a first installation part 201, and the width of a longitudinal section of the locking part 204 is greater than that of a longitudinal section of the first installation part 201 at a joint therebetween; the locking part 204 may be installed in the locking groove 108 and is in interference fit therewith to further lock the first installation part 201 in the first installation groove 103; when the first installation part 201 tends to slide out of the first installation groove 103 or rotate relative to the first installation groove 103, the locking part 204 located in the locking groove 108 produces a reaction force on the first installation part 201, so that the first installation part 201 is less likely to slide out or rotate; likewise, a light-transmitting waterproof part 202 connected with the first installation part 201 is also less likely to rotate to generate wrinkles, so that the special-shaped light-transmitting seal 2 has a better sealing effect, and the light has better waterproof performance; the longitudinal section of the locking part 204 is triangular, circular, oval or trapezoidal; and a narrower portion of the locking part 204 is first installed into the locking groove 108, so that installation is easier. It is worth noting that, the locking groove 108 is arranged on both of a cover body 101 and a connecting piece 102, that is, the complete locking groove 108 is formed by combining a groove body part designed on the cover body 101 with a groove body part designed on the connecting piece 102, and of course, the locking groove 108 may be also arranged on the cover body 101 or the connecting piece 102 alone, which may also achieve a similar effect.

Embodiment 4

A difference from the embodiment 1, the embodiment 2 and the embodiment 3 is that, referring to FIGS. 14-17, in this embodiment, a special-shaped light-transmitting seal 2 further includes a vacuum suction part 205; the vacuum suction part 205 is annular and connected with a first installation part 201; the vacuum suction part 205 is provided with clamping strips 207 and an elastic suction cup 206 configured to cooperatively suck the bottom of a first installation groove 103; the clamping strips 207 are arranged on an outer edge of the elastic suction cup 206; a clamping groove 208 configured to accommodate the clamping strips 207 are formed in a joint between an inner groove wall of the first installation groove 103 and the bottom of the first installation groove 103 in a sunken manner; and through the vacuum suction part 205, when a light housing is tightened, the vacuum suction part 205 and the bottom of the first installation groove 103 are subjected to vacuum suction and fixation to prevent a deformation-resistant sealing ring from being extruded and deformed, which is beneficial to prevent water from seeping into a light housing at a deformed wrinkled position to cause damage. A specific installation principle of the special-shaped light-transmitting seal 2 is as follows: referring to FIG. 14 and FIG. 15, the first installation part 201 of the special-shaped light-transmitting seal 2 is accommodated in the first installation groove 103, and clamping strips 207 of an elastic suction cup 206 are in contact with the bottom of the first installation groove 103; then, referring to FIG. 16 and FIG. 17, in a process of gradually tightening and fixing a top cover 1 and a bottom cover 3, an edge of the bottom cover 3 is in contact with a force-receiving part, and the force-receiving part is gradually pressed to move toward the bottom of the first installation groove 103, so that the air in the elastic suction cup 206 is pressed out; and referring to FIG. 15, a section of the elastic suction cup 206 is conical, and the elastic suction cup 206 is one 206 made of a silica gel material or other elastic materials. Next, an inner surface of the elastic suction cup 206 is completely close to the bottom of the first installation groove 103, so that a space formed between the elastic suction cup 206 and the bottom of the first installation groove 103 has a pressure difference with the outside, and the elastic suction cup 206 of the deformation-resistant sealing ring is pressed at the bottom of the first installation groove 103 by the outside air to be fixed. Meanwhile, the clamping strips 207 are extended during unfolding of the elastic suction cup 206 to be accommodated in the clamping groove 208 to realize an insertion connection. In this way, when the top cover 1 and the bottom cover 3 are tightened, since the deformation-resistant sealing ring is sucked to the bottom of the first installation groove 103 through the elastic suction cup 206, the deformation-resistant sealing ring is prevented from being extruded and deformed to form the wrinkled position, thereby improving the waterproof performance, and preventing the water from seeping into the light housing. Meanwhile, since the top cover 1 and the bottom cover 3 generally rotate in a horizontal direction, wrinkling is caused in an extrusion deformation direction that is a vertical direction; an area in the horizontal direction is enlarged by the clamping strips 207 to increase the difficulty of wrinkling and further improve the waterproof performance; and preferably, the clamping groove 208 of the clamping strips 207 is the annular clamping groove 208 of the annular clamping strips 207.

Embodiment 5

Figure 18:
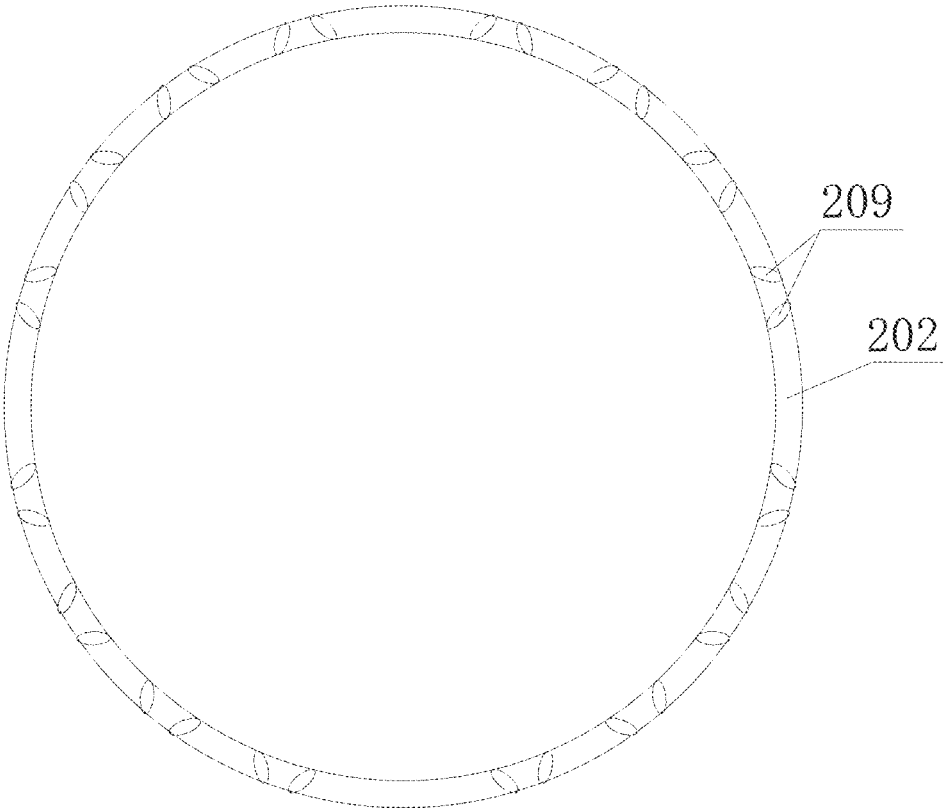
FIG. 18 shows a cross-sectional view of a light-transmitting waterproof part of a special-shaped light-transmitting seal in an embodiment 5.

A difference from the embodiment 1, the embodiment 2, the embodiment 3 and the embodiment 4 is that, referring to FIG. 18, a plurality of reflectors 209 are arranged in a light-transmitting waterproof part 202 at intervals, and the reflectors 209 are those 209 made of polymethyl methacrylate (PMMA) materials. Through the arrangement, light emitted by LED lights 4034 passes through a refraction part 1013 to reach the light-transmitting waterproof part 202, and by the reflectors 209 arranged in the light-transmitting waterproof part 202, the light is reflected in the light-transmitting waterproof part 202, thereby making a whole special-shaped light-transmitting seal 2 emit light, achieving a dazzling effect, and improving viewing pleasure. PMMA is a transparent thermoplastic polymer, adopting polymethyl methacrylate, and an important plastic polymer material, with the advantages of better transparency, chemical stability and weather resistance, easy dyeing and processing, and attractive appearance.

The above is merely the embodiments of the present disclosure, and is not used to limit the present disclosure. For those skilled in the art, various modifications and variations of the present invention are possible. Any modification, equivalent replacement, improvement, etc. made within the spirit and principle of the present disclosure shall be included within the scope of the claims of the present disclosure.

What is claimed is:

1. An underwater diving light with efficient waterproof performance, comprising a top cover, a bottom cover, a light-emitting assembly and a light-transmitting seal, wherein the top cover is provided with a first installation groove; the first installation groove is arranged outside an opening of the top cover; the bottom cover is provided with a second installation groove; the second installation groove is arranged outside an opening of the bottom cover; the light-transmitting seal comprises a light-transmitting waterproof part, a first installation part accommodated in the first installation groove and a second installation part accommodated in the second installation groove; the first installation part, the light-transmitting waterproof part and the second installation part are connected in sequence; the light-transmitting waterproof part is arranged outside the first installation groove; the light-transmitting waterproof part abuts on an outer edge of the first installation groove; the outer edge of the first installation groove is provided with a refraction part configured to allow light emitted by the light-emitting assembly to penetrate the top cover; the light-transmitting waterproof part and the refraction part correspond to each other in position; the top cover and the bottom cover are movably connected to form a light housing with an accommodating space; the light-emitting assembly is arranged in the light housing; a plurality of groups of reflectors are arranged in the light-transmitting waterproof part at intervals; each of the plurality of groups of reflectors comprises four pairs of reflectors; and each of the four pairs of reflectors comprises two reflectors arranged in a non-parallel manner.

2. The underwater diving light with efficient waterproof performance according to claim 1, wherein the first installation part comprises a first sub-part and a second sub-part arranged from bottom up; widths of longitudinal sections of the first sub-part are all the same from bottom up; widths of longitudinal sections of the second sub-part are gradually reduced from bottom up; and an inner space of the first installation groove matches with the first installation part in shape.

3. The underwater diving light with efficient waterproof performance according to claim 1, wherein widths of longitudinal sections of the second installation part are gradually reduced from top down; and an inner space of the second installation groove matches with the second installation part in shape.

4. The underwater diving light with efficient waterproof performance according to claim 1, wherein the top cover comprises a connecting piece and a cover body; an opening of the cover body is arranged downwards; the connecting piece is fixedly connected to an edge of an inner side wall of the cover body; the connecting piece is made of a non-light-transmitting material; and the cover body is made of a light-transmitting material.

5. The underwater diving light with efficient waterproof performance according to claim 1, wherein the light-transmitting seal is made of an elastic transparent material.

6. The underwater diving light with efficient waterproof performance according to claim 1, wherein a bottom of an outer wall of the bottom cover is fixedly provided with suction cup buckles.

7. The underwater diving light with efficient waterproof performance according to claim 1, further comprising a moisture-proof cover, wherein desiccants are stored in the moisture-proof cover.

8. The underwater diving light with efficient waterproof performance according to claim 1, wherein the refraction part is a plurality of light-transmitting mirrors arranged at intervals on the outer edge of the first installation groove.

9. The underwater diving light with efficient waterproof performance according to claim 1, wherein the light-transmitting seal further comprises a vacuum suction part; the vacuum suction part is connected with the first installation part; the vacuum suction part is provided with clamping strips and an elastic suction cup configured to cooperatively suck a bottom of the first installation groove; the clamping strips are arranged on an outer edge of the elastic suction cup; and a clamping groove configured to accommodate the clamping strips are formed in a joint between an inner groove wall of the first installation groove and the bottom of the first installation groove in a sunken manner.

10. The underwater diving light with efficient waterproof performance according to claim 1, wherein the top cover is further provided with a locking groove; a longitudinal section of the locking groove is triangular, circular, oval or trapezoidal; the locking groove communicates with the first installation groove; a width of the longitudinal section of the locking groove is greater than a width of a longitudinal section of the first installation groove at a joint between the locking groove and the first installation groove; the light-transmitting seal further comprises a locking part; the locking part is connected with the first installation part; and a width of a longitudinal section of the locking part is greater than a width of a longitudinal section of the first installation part at a joint between the locking part and the first installation part.

* * * * *